US009982463B2

(12) United States Patent
Yang

(10) Patent No.: US 9,982,463 B2
(45) Date of Patent: May 29, 2018

(54) BLOCKING STRUCTURE OF ANTI-FIRE DOOR LOCK

(71) Applicant: TAIWAN FU HSING INDUSTRIAL CO., LTD., Kaohsiung (TW)

(72) Inventor: Ju-Kuan Yang, Changhua County (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 582 days.

(21) Appl. No.: 14/632,068

(22) Filed: Feb. 26, 2015

(65) Prior Publication Data

US 2016/0145907 A1 May 26, 2016

(30) Foreign Application Priority Data

Nov. 20, 2014 (TW) ..... 103220636 U

(51) Int. Cl.

| | |
|---|---|
| ***E05B 65/10*** | (2006.01) |
| ***E05C 3/12*** | (2006.01) |
| ***E05B 15/10*** | (2006.01) |
| *E05C 3/16* | (2006.01) |

(52) U.S. Cl.

CPC ..... *E05B 65/104* (2013.01); *E05B 15/102* (2013.01); *E05B 65/1006* (2013.01); *E05C 3/124* (2013.01)

(58) Field of Classification Search

CPC ..... Y10T 292/0908; Y10T 292/0909; Y10T 292/091; Y10T 292/1043; Y10T 292/1051; Y10T 292/1054; Y10T 292/1055; Y10T 292/106; Y10T 292/1089; Y10T 70/5159; Y10T 292/1078; Y10T 292/1059; Y10S 292/36; Y10S 292/41; Y10S 292/55; Y10S 292/59; Y10S 292/65; Y10S 292/66; E05B 15/02; E05B 65/104; E05B 65/1006; E05B 65/10; E05C 3/124

See application file for complete search history.

(56) References Cited

U.S. PATENT DOCUMENTS

| | | | | | |
|---|---|---|---|---|---|
| 3,705,739 | A | * | 12/1972 | Adler | E05B 65/104 16/48.5 |
| 4,003,593 | A | * | 1/1977 | Wilzig | E05B 65/104 292/165 |
| 4,007,954 | A | * | 2/1977 | Erickson | E05B 65/104 292/165 |
| 4,015,869 | A | * | 4/1977 | Horvath | E05B 65/104 292/341.16 |
| RE30,263 | E | * | 4/1980 | Horvath | E05B 65/104 292/341.16 |
| 4,598,939 | A | * | 7/1986 | Krupicka | E05B 65/104 292/210 |

(Continued)

*Primary Examiner* — Alyson M Merlino
(74) *Attorney, Agent, or Firm* — Jackson IPG PLLC; Demian K. Jackson

(57) ABSTRACT

A blocking structure of an anti-fire door lock includes a latch set, a blocking pin set and a blocking base, wherein the latch set comprises a lock base and a latch that pivotally connected to the lock base. The blocking pin set disposed in an accommodating hole of the latch comprises a blocking pin and an elastic member, and the blocking base comprises a constraining slot. The elastic member is used for pushing the blocking pin to move and making the blocking pin to lodge into the constraining slot to prevent an anti-fire door from being opened.

9 Claims, 6 Drawing Sheets

(56) References Cited

U.S. PATENT DOCUMENTS

| | | | | | |
|---|---|---|---|---|---|
| 4,709,950 | A * | 12/1987 | Zortman | E05B 65/104 | 292/198 |
| 4,884,832 | A * | 12/1989 | Bungard | E05B 65/104 | 292/150 |
| 5,782,509 | A * | 7/1998 | Uyeda | E05B 65/104 | 292/341.17 |
| 5,890,752 | A * | 4/1999 | Lin | E05B 65/104 | 292/92 |
| 8,556,306 | B1 * | 10/2013 | Lin | E05B 65/104 | 292/157 |
| 8,562,032 | B1 * | 10/2013 | Lin | E05C 7/06 | 292/157 |

* cited by examiner

BLOCKING STRUCTURE OF ANTI-FIRE DOOR LOCK

FIELD OF THE INVENTION

The present invention is generally relating to a blocking structure of an anti-fire door lock. The invention particularly represents the blocking structure has a blocking pin disposed in a latch, wherein the blocking pin is wedged in a blocking base.

BACKGROUND OF THE INVENTION

With reference to FIG. 6, a conventional blocking structure of an anti-fire door lock 400 comprises a latch set 410 and a blocking base 420, wherein the latch set 410 is mounted on an anti-fire door 500, and the blocking base 420 is mounted on a door frame 600. The latch set 410 comprises a main body 411, a latch 412 and a linking set 413, and wherein the latch 412 pivotally connects to the main body 411. The latch 412 is able to protrude to the main body 411 or retract in the main body 411 selectively by the linking set 413 to make the anti-fire door 500 being opened or closed relative to the door frame 600. The latch 412 comprises a blocking surface 412*a*, and wherein the blocking surface 412*a* contacts against the blocking base 420 to prevent the anti-fire door 500 from being opened when the latch 412 protrudes to the main body 411. Oppositely, the blocking base 420 can not constrain the latch 412 when the latch 412 retracts in the body 411, therefore, the anti-fire door 500 is able to be opened.

With reference to FIG. 6, the anti-fire door 500 is deformed because the elevation of environmental temperature while a fire accident occurs, and the latch set 410 produces displacement relative to the blocking base 420 at the same time. The anti-fire door 500 is able to be opened and is unable to achieve the function of fire excluding when the latch 412 is displaced to make the blocking surface 412*a* unable to contact against the blocking base 420.

SUMMARY

The primary object of the present invention is to provide a blocking structure of an anti-fire door lock, wherein a blocking pin disposed in a latch is lodged into a constraining slot of a blocking base to prevent an anti-fire door from being opened while a fire accident occurs.

In the present invention, the blocking structure of the anti-fire door lock includes a latch set, a blocking pin set and a blocking base, wherein the latch set comprises a lock base and a latch, and the lock base comprises a main body and an accommodating slot. The latch disposed in the accommodating slot comprises a pivoting portion and a blocking portion, wherein the pivoting portion pivotally connects to the main body, and the blocking portion protrudes to the main body or retracts into the main body selectively by swinging around the pivoting portion as a swing center. The blocking portion comprises an accommodating hole having a constrained opening. The blocking pin set disposed in the accommodating hole swings simultaneously with the blocking portion, wherein the blocking pin set comprises a blocking pin and an elastic member. The blocking pin comprises a first constraining portion and a second constraining portion connected to the first constraining portion, wherein the first constraining portion of the blocking pin compresses the elastic member to make the elastic member produce an elastic restoration force when the blocking pin is located at a first position. The blocking base mounted on a door frame comprises a constraining slot, wherein the blocking pin moves from the first position to a second position when the elastic member pushes the blocking pin to move toward the constrained opening by the elastic restoration force, the second constraining portion is lodged into the constraining slot, and the first constraining portion is constrained in the accommodating hole.

The elastic member of the present invention pushes the blocking pin to make the second constraining portion of the blocking pin lodged into the blocking base and the first constraining portion of the blocking pin is constrained in the accommodating hole of the latch while a fire accident occurs. Therefore, the blocking pin enables to block the latch set and the blocking base to prevent the latch set mounted on the anti-fire door from departing from the blocking base mounted on the door frame, thus preventing the anti-fire door from being opened and achieving the function of fire excluding.

DETAILED DESCRIPTION OF THE INVENTION

Figure 1:
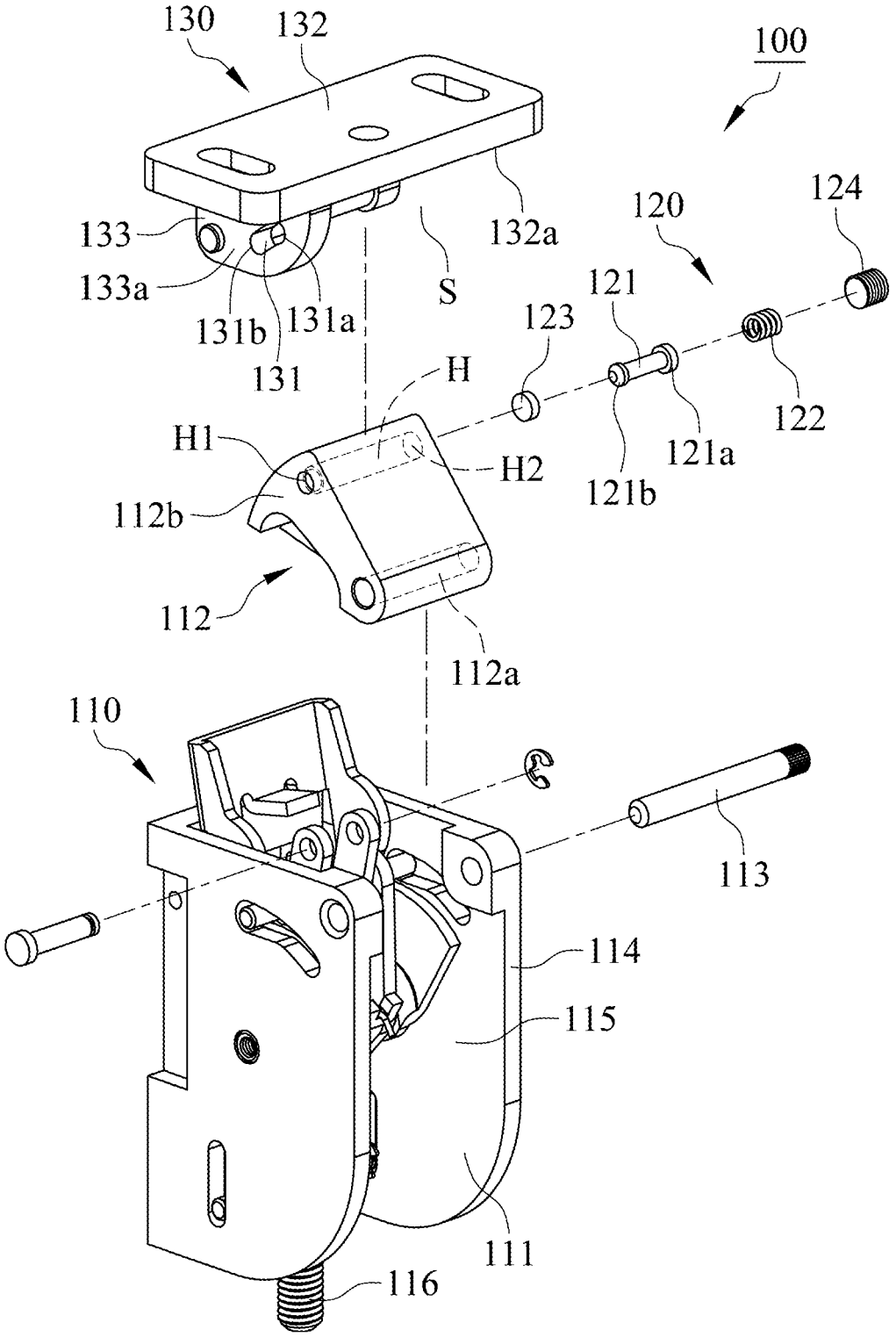
FIG. 1 is a perspective exploded view illustrating a blocking structure of an anti-fire door lock in accordance with the present invention.
Figure 2:
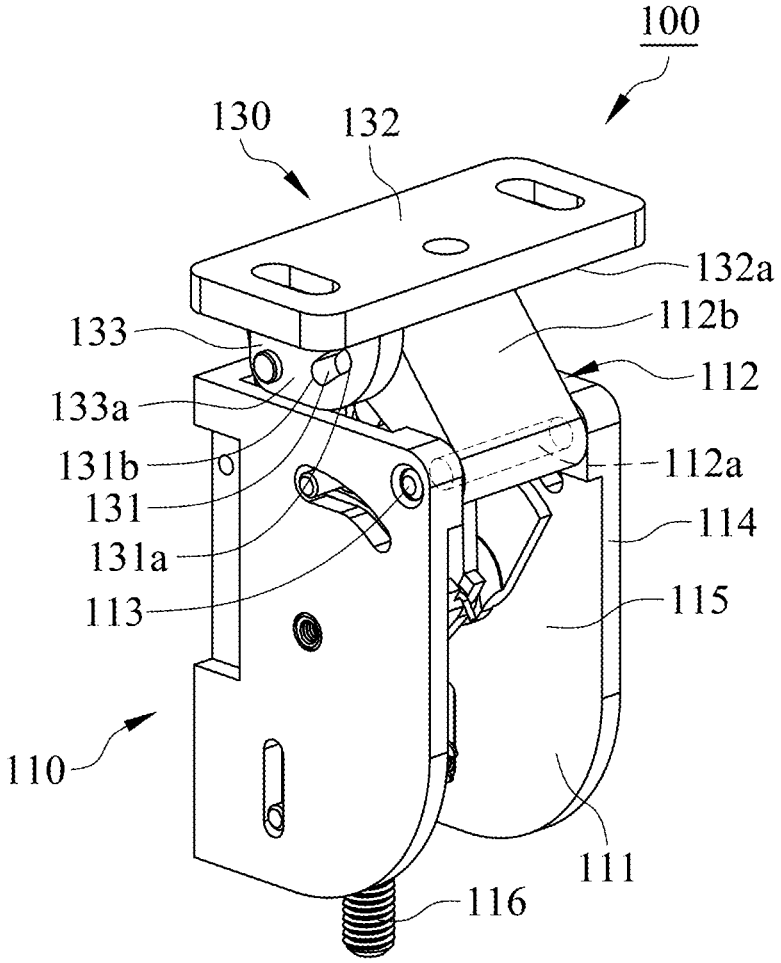
FIG. 2 is a perspective assembly view illustrating the blocking structure of the anti-fire door lock in accordance with the present invention.
Figure 3:
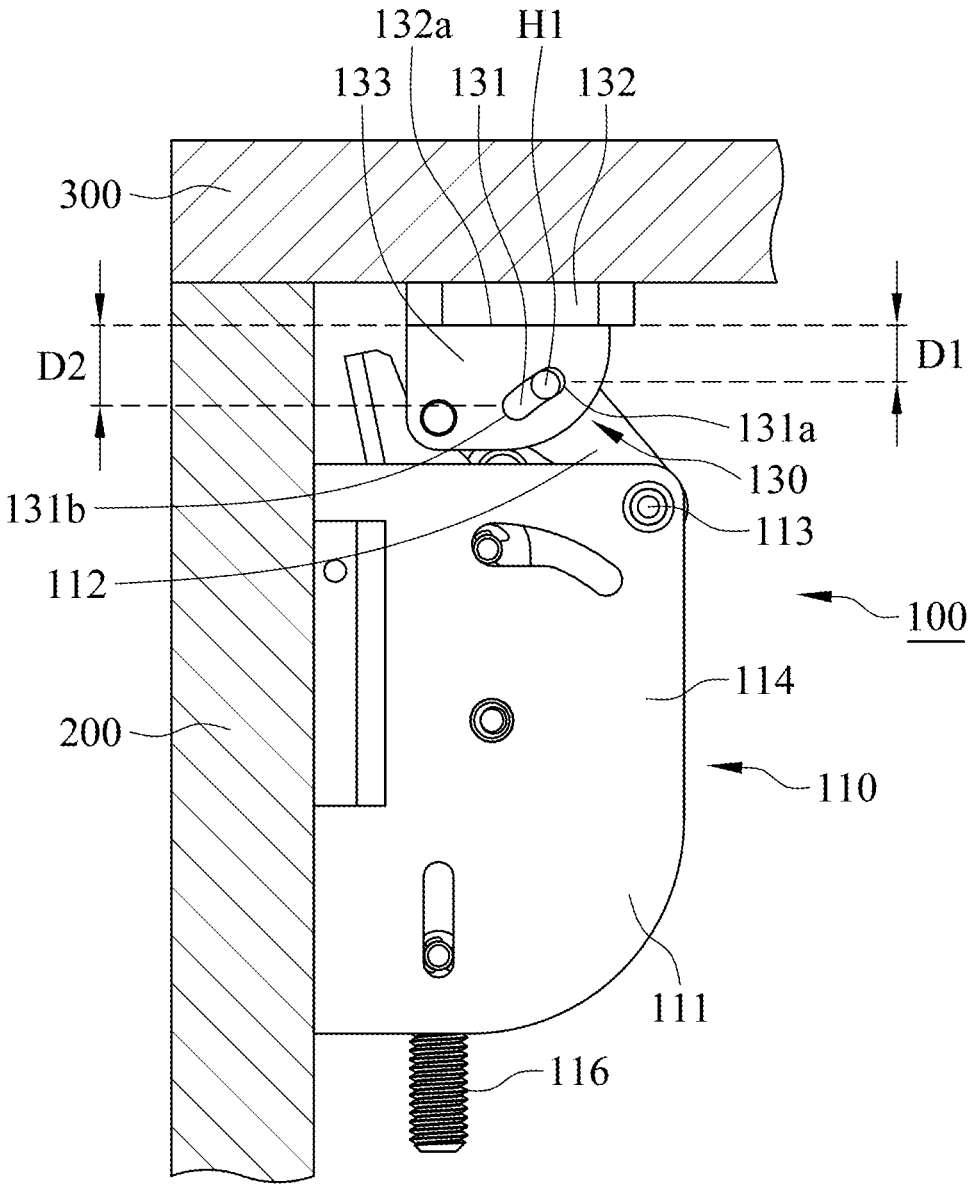
FIG. 3 is a lateral view illustrating the blocking structure of the anti-fire door lock mounted on an anti-fire door and a door frame in accordance with the present invention.

With reference to FIGS. 1 and 2, a blocking structure of an anti-fire door lock 100 in accordance with a preferred embodiment of the present invention comprises a latch set 110, a blocking pin set 120 and a blocking base 130. With reference to FIG. 3, the latch set 110 is mounted on an anti-fire door 200, the blocking base 130 is mounted on a door frame 300, and the anti-fire door 200 is engaged with the door frame 300 and able to be opened or closed relative to the door frame 300.

Figure 4:
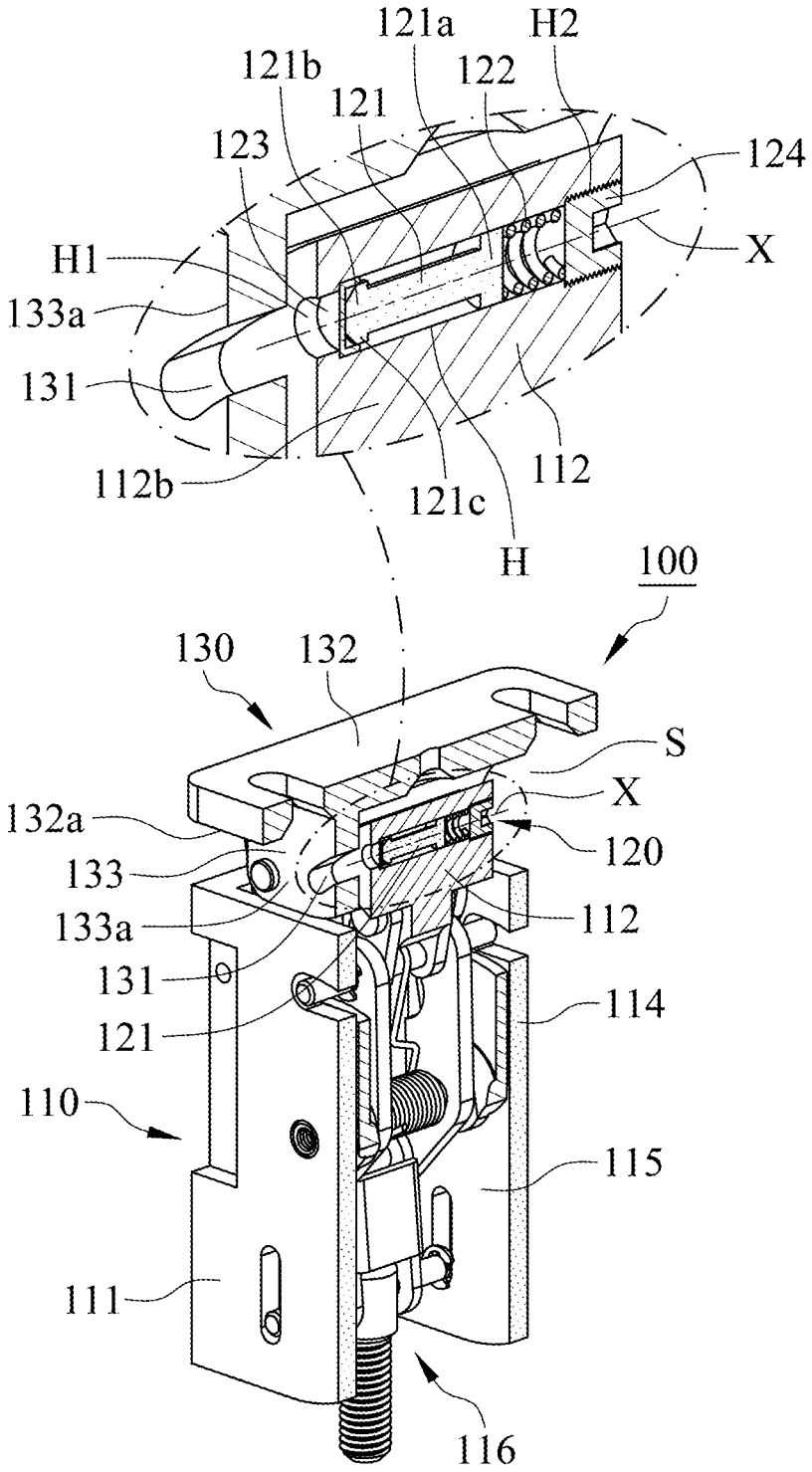
FIG. 4 is a section view illustrating a blocking pin set of the blocking structure before operation in accordance with FIG. 2.

With reference to FIGS. 1, 2 and 4, the latch set 110 comprises a lock base 111, a latch 112 and a pivoting rod 113. The lock base 111 comprises a main body 114, an accommodating slot 115 and a linking set 116, wherein the accommodating slot 115 is surrounded by the main body 114. The latch 112, the pivoting rod 113 and the linking member 116 are disposed in the accommodating slot 115. The latch 112 comprises a pivoting portion 112*a* and a blocking portion 112*b*, wherein the pivoting portion 112*a* of the latch 112 pivotally connects to the main body 114 by the pivoting rod 113. The latch 112 is driven by the linking set 116 to make the blocking portion 112*b* of the latch 112 protruding to the main body 114 or retracting in the main body 114 selectively by swinging around the pivoting portion 112*a* as a swing center.

With reference to FIGS. 1 and 4, the blocking portion 112*b* of the latch 112 comprises an accommodating hole H, wherein the blocking pin set 120 is disposed in the accommodating hole H and swings with the blocking portion 112*b* simultaneously. In this embodiment, the accommodating hole H comprises a constrained opening H1 and an installation opening H2. The blocking pin set 120 comprises a blocking pin 121 and an elastic member 122. With reference to FIG. 4, the blocking pin 121 compresses the elastic member 122 to make the elastic member 122 produce an elastic restoration force when the blocking pin 121 is located at a first position.

With reference to FIGS. 1 and 4, the blocking pin set 120 further comprises a blocking member 123 and a fixing member 124, wherein the blocking member 123 is a low melting point material and the melting point of the fixing member 124 is higher than the melting point of the blocking member 123. In this embodiment, the blocking member 123 is a plastic material. The blocking member 123 is disposed at the constrained opening H1 of the accommodating hole H, and the fixing member 124 is engaged with the installation opening H2 of the accommodating hole H. Preferably, the fixing member 124 is selected from a screw or a pillared bolt. The blocking pin 121 is located between the blocking member 123 and the elastic member 122, and the elastic member 122 is located between the blocking pin 121 and the fixing member 124. One end of the elastic member 122 pushes the blocking pin 121, and the other end of the elastic member 122 pushes the fixing member 124. In this embodiment, the blocking pin 121 comprises a first constraining portion 121*a* and a second constraining portion 121*b* connected to the first constraining portion 121*a*, wherein the first constraining portion 121*a* is located between the second constraining portion 121*b* and the elastic member 122, the first constraining portion 121*a* contacts against the elastic member 122, and the second constraining portion 121*b* contacts against the blocking member 123.

With reference to FIGS. 1, 2 and 4, the blocking base 130 comprises a constraining slot 131 corresponded to the constrained opening H1 of the accommodating hole H. Referring to FIG. 4, an axis line X passes through the constraining slot 131 of the blocking base 130 and the accommodating hole H of the blocking portion 112*b* when the blocking portion 112*b* of the latch 112 protrudes to the main body 114 of the locking base 111.

With reference to FIGS. 1, 2 and 4, in this embodiment, the blocking base 130 further comprises a base 132 and a lateral plate 133 protrudes to a bottom surface 132*a* of the base 132, wherein the constraining slot 131 is disposed on the lateral plate 133. A constraining space S is defined between the bottom surface 132*a* of the base 132 and the lateral plate 133. The blocking portion 112*b* is constrained in the constraining space S when the blocking portion 112*b* of the latch 112 protrudes to the main body 114 of the locking base 111.

With reference to FIGS. 1, 2 and 3, in this embodiment, the constraining slot 131 is an arc-shaped long slot that penetrates through the lateral plate 133. Referring to FIG. 3, the constraining slot 131 comprises a first end 131*a* and a second end 131*b*, wherein a first spacing D1 is spaced apart between the first end 131*a* and the base 132, a second spacing D2 is spaced apart between the second end 131*b* and the base 132, and the first spacing D1 is smaller than the second spacing D2.

Figure 5:
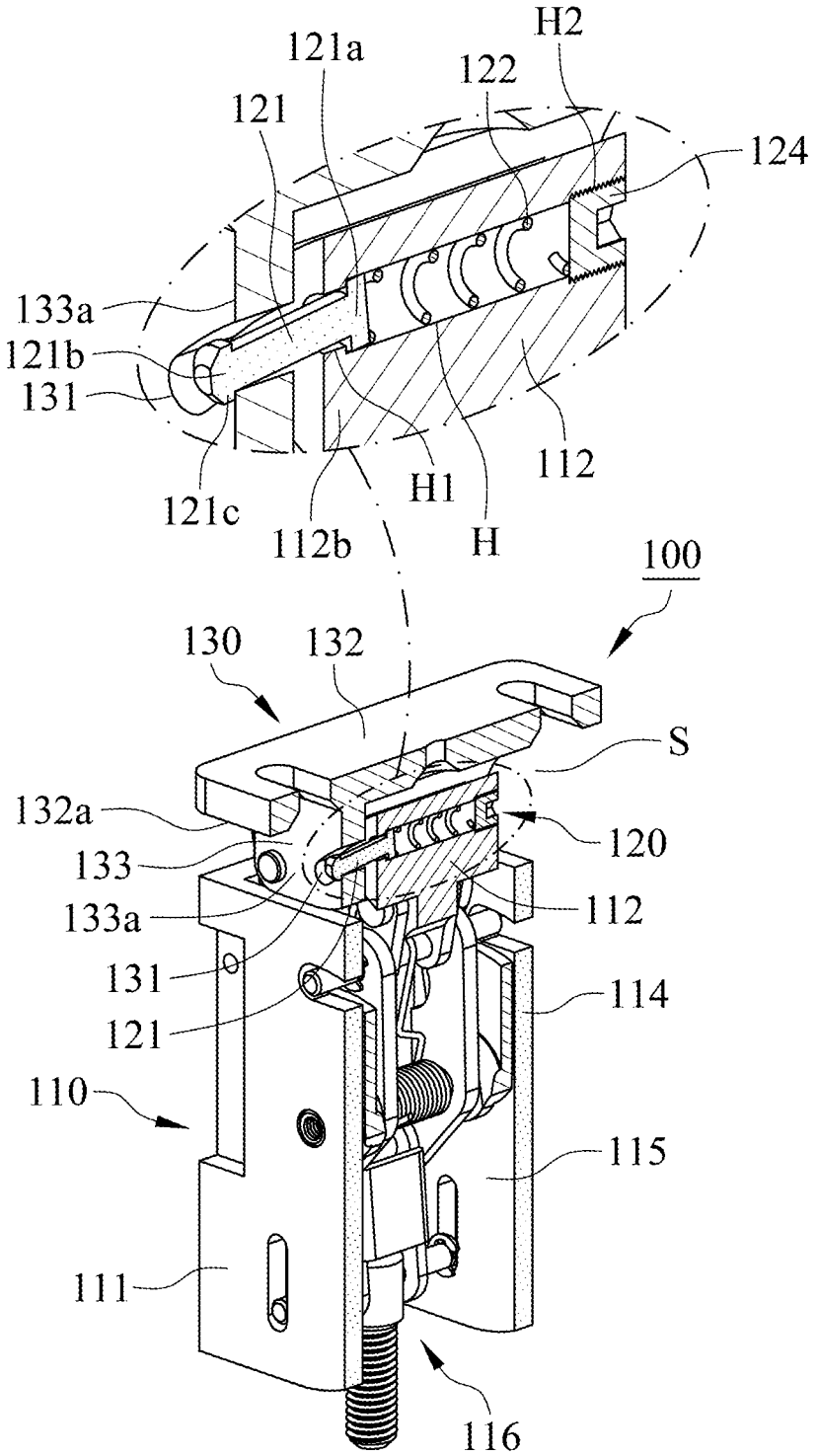
FIG. 5 is a section view illustrating the blocking pin set of the blocking structure after operation in accordance with FIG. 2.
Figure 6:
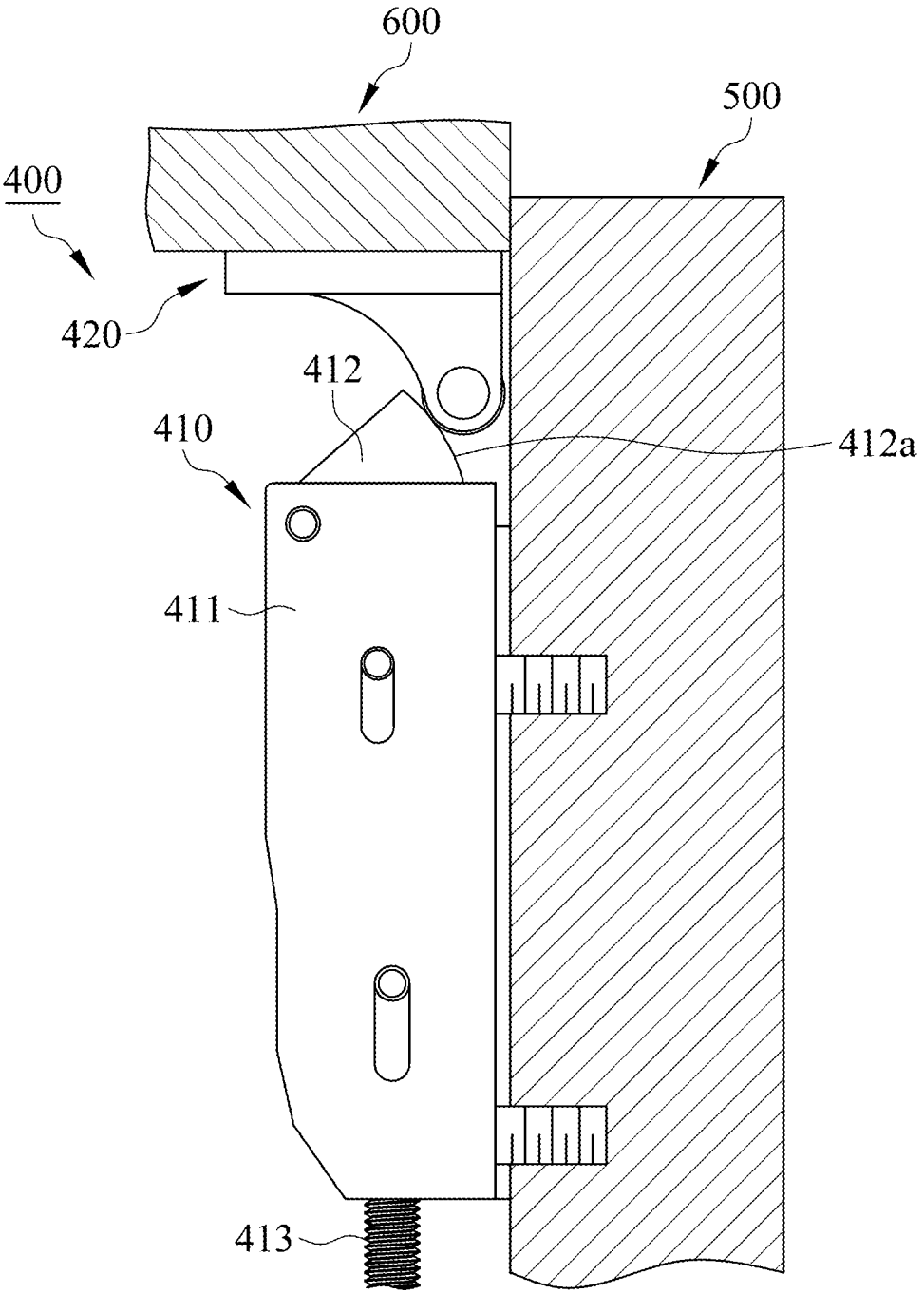
FIG. 6 PRIOR ART
FIG. 6 is a lateral view of a conventional anti-fire door lock mounted on an anti-fire door and a door frame.

With reference to FIG. 5, the blocking member 123 is melted because the elevation of environment temperature while a fire accident occurs and is unable to constrain the blocking pin 121 in the accommodating hole H. Therefore, the elastic member 122 is able to push the blocking pin 121 to move toward the constrained opening H1 by the elastic restoration force to make the blocking pin 121 move along the axis line X from the first position (disclosed in FIG. 4) to a second position (disclosed in FIG. 5).

With reference to FIG. 5, the second constraining portion 121*b* is lodged into the constraining slot 131 of the blocking base 130 and the first constraining portion 121*a* is constrained in the accommodating hole H when the blocking pin 121 moves to the second position. The blocking pin 121 constrained in the constraining slot 131 and the accommodating hole H simultaneously prevents the latch 112 from departing from the blocking base 130 and prevents the anti-fire door 200 from being opened.

With reference to FIGS. 1 and 5, preferably, the second constraining portion 121*b* of the blocking pin 121 comprises a wedging member 121*c*. The wedging member 121*c* passes through the constraining slot 131, protrudes to the lateral plate 133 and is blocked by an outer lateral surface 133*a* of the later plate 133 when the blocking pin 121 moves from the first position to the second position. The blocking pin 121 retracted from the constraining slot 131 to the accommodating hole H is avoidable by the wedging member 121*c* to prevent the latch set 110 from departing from the blocking base 130 and prevent the anti-fire door 200 from being opened.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A blocking structure of an anti-fire door lock, said blocking structure includes:

a latch set having a lock base and a latch, wherein the lock base comprises a main body and an accommodating slot, the latch is disposed in the accommodating slot and comprises a pivoting portion and a blocking portion, the pivoting portion pivotally connects the latch to the main body by a pivoting rod, the blocking portion selectively protrudes from the main body or retracts into the main body by swinging about the pivoting rod and the blocking portion comprises an accommodating hole having a constrained opening;

a blocking pin set disposed in the accommodating hole so as to swing together with the blocking portion about the pivoting rod, wherein the blocking pin set comprises a blocking pin and an elastic member, the blocking pin comprises a first constraining portion and a second constraining portion, the second constraining portion is connected to the first constraining portion and comprises a wedging member, the first constraining portion compresses the elastic member to make the elastic member produce an elastic restoration force when the blocking pin is located at a first position; and a blocking base having a lateral plate and a constraining slot disposed in the lateral plate, wherein the blocking pin moves from the first position to a second position in which the first constraining portion is constrained in the accommodating hole of the blocking portion and the wedging member of the second constraining portion passes through the constraining slot and is blocked by an outer lateral surface of the lateral plate such that the second constraining portion is lodged in the constraining slot and wherein the elastic member pushes the blocking pin to move toward the constrained opening and into the second position by the elastic restoration force.

2. The blocking structure of an anti-fire door lock in accordance with claim 1, wherein an axis line passes through the accommodating hole and the constraining slot when the blocking portion of the latch protrudes from the main body.

3. The blocking structure of an anti-fire door lock in accordance with claim 2, wherein the blocking base comprises a base and the lateral plate is disposed on the base.

4. The blocking structure of an anti-fire door lock in accordance with claim 3, wherein the constraining slot comprises a first end and a second end, a first spacing exists between the first end and the base of the blocking base and a second spacing exists between the second end and the base of the blocking base, wherein the first spacing is smaller than the second spacing.

5. The blocking structure of an anti-fire door lock in accordance with claim 1, wherein the blocking pin set further comprises a blocking member, the blocking pin is located between the blocking member and the elastic member such that the second constraining portion of the blocking pin contacts against the blocking member when the blocking pin is in the first position.

6. The blocking structure of an anti-fire door lock in accordance with claim 5, wherein the blocking member is formed of a low melting point material such that when the blocking member is exposed to heat of a sufficient temperature, the blocking member melts, allowing the blocking pin to be moved to the second position by the elastic restoration force of the elastic member.

7. The blocking structure of an anti-fire door lock in accordance with claim 1, wherein the blocking pin set further comprises a fixing member engaged with an installation opening of the accommodating hole, and the elastic member is located between the blocking pin and the fixing member.

8. The blocking structure of an anti-fire door lock in accordance with claim 5, wherein the blocking pin set further comprises a fixing member engaged with an installation opening of the accommodating hole, and the elastic member is located between the blocking pin and the fixing member.

9. The blocking structure of an anti-fire door lock in accordance with claim 8, wherein a melting point of the fixing member is higher than a melting point of the blocking member such that when the blocking member is exposed to heat of a sufficient temperature, the blocking member melts, allowing the blocking pin to be moved to the second position by the elastic restoration force of the elastic member.

* * * * *